United States Patent [19]

Haynes

[11] Patent Number: 4,458,751

[45] Date of Patent: Jul. 10, 1984

[54] METHOD AND APPARATUS FOR SELECTIVE DISENGAGEMENT OF A FLUID TRANSMISSION CONDUIT OPERABLE UNDER OPPOSITELY DIRECTED PRESSURE DIFFERENTIALS

[75] Inventor: Andrew Haynes, Missouri City, Tex.

[73] Assignee: Baker International Corporation, Orange, Calif.

[21] Appl. No.: 265,725

[22] Filed: May 21, 1981

[51] Int. Cl.[3] ..... E21B 33/129

[52] U.S. Cl. ..... 166/133; 166/331

[58] Field of Search ..... 166/331, 330, 332, 334, 166/250, 143, 149, 150, 131, 133

[56] References Cited

U.S. PATENT DOCUMENTS

| | | | |
|---|---|---|---|
| 3,347,318 | 10/1967 | Barrington . | |
| 3,398,928 | 8/1968 | Fredd . | |
| 3,442,328 | 5/1969 | Nutter . | |
| 3,509,913 | 5/1970 | Lewis | 166/321 |
| 3,543,793 | 12/1970 | Dollison . | |
| 3,703,193 | 11/1972 | Raulins . | |
| 4,074,761 | 2/1978 | Mott . | |
| 4,210,207 | 7/1980 | McStravick . | |
| 4,230,185 | 10/1980 | Fredd | 166/332 |
| 4,270,606 | 6/1981 | McStravick et al. | 166/373 |
| 4,293,038 | 10/1981 | Evans | 166/332 |
| 4,293,163 | 10/1981 | Braddick | 251/315 |

OTHER PUBLICATIONS

1978–1979 Composite Catalog of Oil Field Equipment and Services, pp. 6460B and 6971.

*Primary Examiner*—William F. Pate, III

*Attorney, Agent, or Firm*—Norvell & Associates

[57] ABSTRACT

An apparatus and method for the insertion and disengagement of a tubing string used in a subterranean well subject to oppositely directed pressure differentials is disclosed. A packer apparatus which anchors a portion of the tubing string against rotation is used in conjunction with a disengagable on/off connector and a valve apparatus capable of withstanding oppositely directed pressure differentials. The valve apparatus can be selectively opened and closed by rotary manipulation of the tubing string through the disengagable on/off connector. Portions of the tubing string above the valve apparatus can then be inserted into the well or removed from the well or tested for pressure integrity.

6 Claims, 13 Drawing Figures

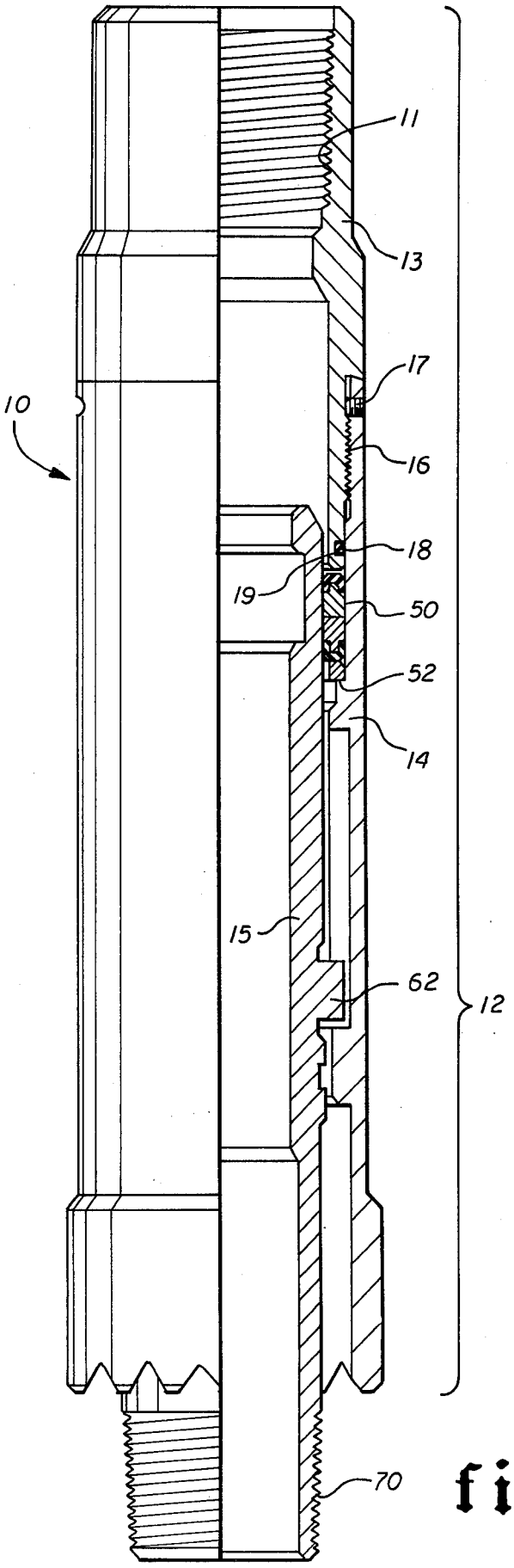
fig.12
fig.13
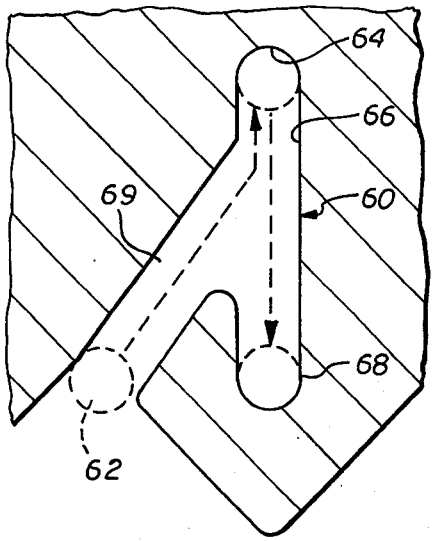

METHOD AND APPARATUS FOR SELECTIVE DISENGAGEMENT OF A FLUID TRANSMISSION CONDUIT OPERABLE UNDER OPPOSITELY DIRECTED PRESSURE DIFFERENTIALS

BACKGROUND OF THE INVENTION

1. FIELD OF THE INVENTION

This invention relates to a fluid transmission conduit assembly for use in a subterranean well to isolate fluid flow passing therethrough.

2. DESCRIPTION OF THE PRIOR ART

In order to recover oil in production zones after economical primary production operations have terminated, produced salt water from other zones or reservoirs is injected into the production zone by means of injection wells to cause migration of the remaining oil to the producing well. The salt water generally employed often contains a high solid content and often because of exposure to air at the well surface, the water will also contain a high concentration of dissolved oxygen. The combination of dissolved oxygen in salt water being utilized as a liquid injection medium results in a highly corrosive environment for the tubing used in the producing well. The tubing is not only subjected to this highly corrosive injection medium but it also is subjected to high pressures maintained to increase the initial and normal pressure of the production zone in the vicinity of the injection well bore.

Quite often the increased production zone pressures will cause the injected fluid to back flow through the upper end of the tubing at the top of the well as the tubing is being retrieved. If precautions are not taken, the back flow will result in need for auxiliary disposal means and procedures to avoid potential environmental damage. Typically back flow problems have been avoided by seating a wireline blanking plug into the bore of an on/off sealing connector. The plug prevents flow of fluid in either direction so that the tubing string may be pulled out of the well bore and rerun without back flow of the injected salt water. Such a procedure in not entirely satisfactory because it must be assumed that the tubing string has suffered considerable chemical deterioration resulting from oxygen corrosion and scale deposits such that the time consuming and costly running and sealing engagement of a plug by wireline cannot be reliably accomplished. Alternatively, a weighted fluid may be injected into and circulated through the tubing casing annulus into the well bore above the packer to balance the reservior pressure and thus prevent salt water back flow. This procedure is quite costly, is time consuming, and can lead to additional problems when the weighted fluid is removed from the well. Similar problems may be encountered in salt water disposal operations. Additionally the need to remove tubing strings is encountered in artificial lift wells in which gas lift mandrels must be relocated. If the well is capable of flowing at a reduced rate without artificial lift applications, a means for isolating the flow of fluid through the tubing string must be utilized.

Downhole shutoff valves which may be used with an on/off sealing connector and with a packer apparatus anchoring the tubing string to the oil well casing have been employed in the prior art to deal with these problems. The present invention encompasses the use of an improved downhole shutoff valve with an on/off tubing connector and packing apparatus to provide an assembly permitting the operator to isolate portions of the tubing string by rotary manipulation of the tubing string at the surface of the well. The packer apparatus employed with this assembly normally is designed to selectively latch and sealingly receive the bottom exterior end of the tubing string. The packer apparatus provides sealing engagement along the I.D. of the casing within the tubing casing annulus above the injection zone to completely isolate the annular area thereabove from the injection fluids. The packer apparatus can be set to anchor the tubing string with respect to the oil well casing in various ways, including rotation of the tubing string to anchor the tubing string against rotation in the opposite direction. A downhole shutoff valve can then be inserted in the tubing string at any point above the packer apparatus where flow needs to be stopped. An on/off tubing connector attached immediately above the downhole shutoff valve then permits the withdrawal of the tubing string above the downhole shutoff valve. In this invention, the downhole shutoff valve can be moved from the open to the closed position by rotation of the tubing string in a direction opposite from the initial setting direction of the packer apparatus. The tubing string above the downhole shutoff valve may be retrieved by continued rotation of the tubing string in the direction resulting in closure of the downhole shutoff valve. Such continued rotation will cause disengagement of the on/off connector and the tubing string extending thereabove. Rotation of the tubing string to initially close or open the downhole shutoff valve and subsequently disengage the on/off connector is facilitated by the use of sealing elements in this downhole shutoff valve which provides sealing integrity both from above and below the valve. This assembly can therefore be used when excess pressure exist in the tubing either above or below the valve. The downhole shutoff valve also employs valve activation means which permit a valve to be opened even in the presence of a large pressure differential which might otherwise cause the valve to stick.

SUMMARY OF THE INVENTION

This invention comprises a fluid transmission conduit assembly incorporating a selectively disengagable tubing connector, a valve apparatus responsive to rotary manipulation of a fluid transmission conduit, and means to anchor or restrain a portion of the fluid transmission conduit against rotation. This invention permits the isolation of various portions of the tubing string despite the existence of large pressure differentials generated by excess pressure either above or below the location of the valve apparatus. Seals employed in the valve apparatus permit the valve apparatus to provide pressure integrity both above and below the location of a ball valve head which rotates about an axis transverse to the fluid transmission conduit. Lever actuating means which can be utilized in conjunction with oppositely directed seals to transmit the axial rotation between upper and lower portions of the fluid transmission conduit to the ball valve and permit rotation of the ball valve head about an axis transverse to the fluid transmission conduit.

CROSS REFERENCE

The disclosure of this application is related to the disclosure in my co-pending applications, Valve Operable Under Oppositely Directed Pressure Differentials, Ser. No. 265,866 now U.S. Ser. No. 4,421,171, and Method of Testing a Fluid Transmission Conduit IN A Subterranean Well, Ser. No. 265,870 now aband., filed concurrently herewith.

BRIEF DESCRIPTION OF THE DRAWINGS

FIG. 12 is an elongated partial cross-sectional view of the tubing connector of the present invention in initial position as schematically depicted in FIG. 1.

FIG. 13 is a view of the slot and pin assembly as utilized in the connector illustrated in FIG. 12

DESCRIPTION OF THE PREFERRED EMBODIMENT

Figure 1:
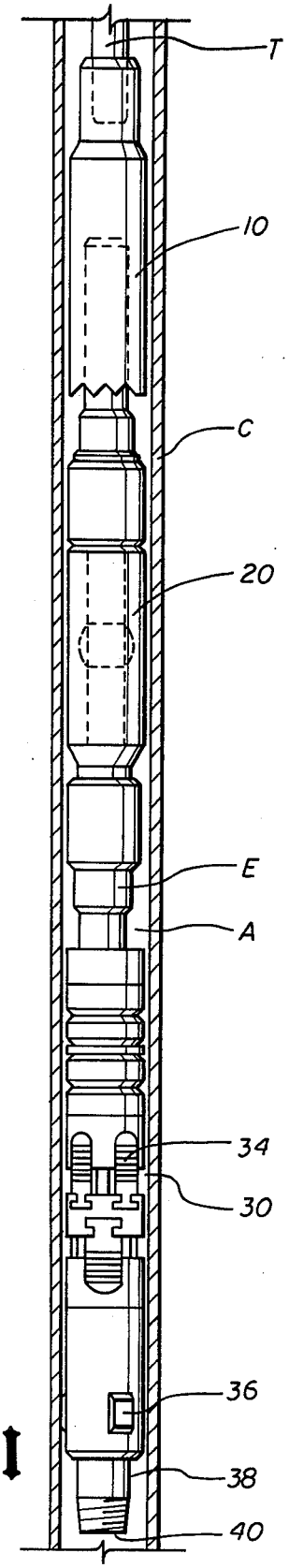
FIG. 1 is a longitudinal schematic illustration showing the apparatus of the present invention inserted within a casing of a well bore above a subterranean zone, the view being taken prior to the setting of the sealing or packer apparatus.

Referring now to FIG. 1, there is shown within the interior casing C (or the second conduit) a tubing connector 10 carried at the lower end of a fluid transmission conduit T, with a valve apparatus 20 affixed and carried at the lower end of the tubing connector 10. A tubing extension E at the lower end of the valve apparatus 20 connects to a packer assembly 30 therebelow. The packer assembly 30 comprises a circumferentially extending elastomeric seal assembly 32 of conventional nature at its upper end defining an annulus A between the packer assembly 30 and the casing C. Elastomeric seal assembly 32 is shown in its retracted position in FIG. 1 and its expanded position in FIG. 2. When the packer assembly 30 is set, the seal assembly 32 sealingly engages along the internal diameter of the casing C to prevent fluid migration across the seal assembly 32. The packer assembly 30 also comprises on its outer body a conventional slip assembly or anchoring means 34 for anchoring engagement on the wall of the casing C to prevent upper and lower movement of the packer assembly 30. A conventional guide 36 at the lowermost portion of the packer assembly guides the assembly 30 within the casing C. A packer extension or other tubular means which may have threads 38 for connection to tools or component parts therebelow is defined at the lower end of the packer assembly 30. Alternatively, the packer extension may simply have defined thereon a port 40 for communication to and injection of fluids into a zone therebelow.

The packer assembly 30 is of conventional design, and may be constructed for permanent set within the well or may be selectively retrievable. In any event, numerous packer assemblies well known to those skilled in the art may be utilized in combination in the present invention, and the particular and selective packer assembly for utilization herein is not necessarily critical to the invention. The packer assemblies selected for use in this invention should be one which defines seal means thereon for prevention of migration of fluid between the annulus A and the injection and which does not allow rotation in at least one direction. For example, the valve apparatus 20 utilized in the preferred embodiment is designed to allow activation upon the rotation of the tubing string to the left. In other words, the packer assembly should be set in such a manner as to restrict movement of the tubing below the valve apparatus 20 and should not allow this tubing to move to the left while at the same time permitting the valve to be actuated upon movement or upon rotation to the left.

The preferred embodiment of the valve apparatus employed in this invention generally comprises a top sub or housing member 100 aligned along the axis of a fluid transmission conduit or tubing T with a bottom sub or housing member 120. Each sub or housing member has a central bore which, when mounted on a fluid transmission conduit, will be axially aligned with the bore of the fluid transmission conduit. A spherical ball valve 160 is internally mounted on the top sub or housing member 100 and is free to rotate about an axis transverse to, and in this embodiment perpendicular to, the axis of the housing members and the fluid transmission conduit T. Ball valve 160 has a central flow passage 182 which may be selectively aligned with the bores of the housing members upon mutual rotation between the top sub or housing member 100 and bottom sub or housing member 120. A lever 134 is provided to transfer the axial rotation of the fluid conduit and the sub or housing members to the ball valve.

Figure 3:
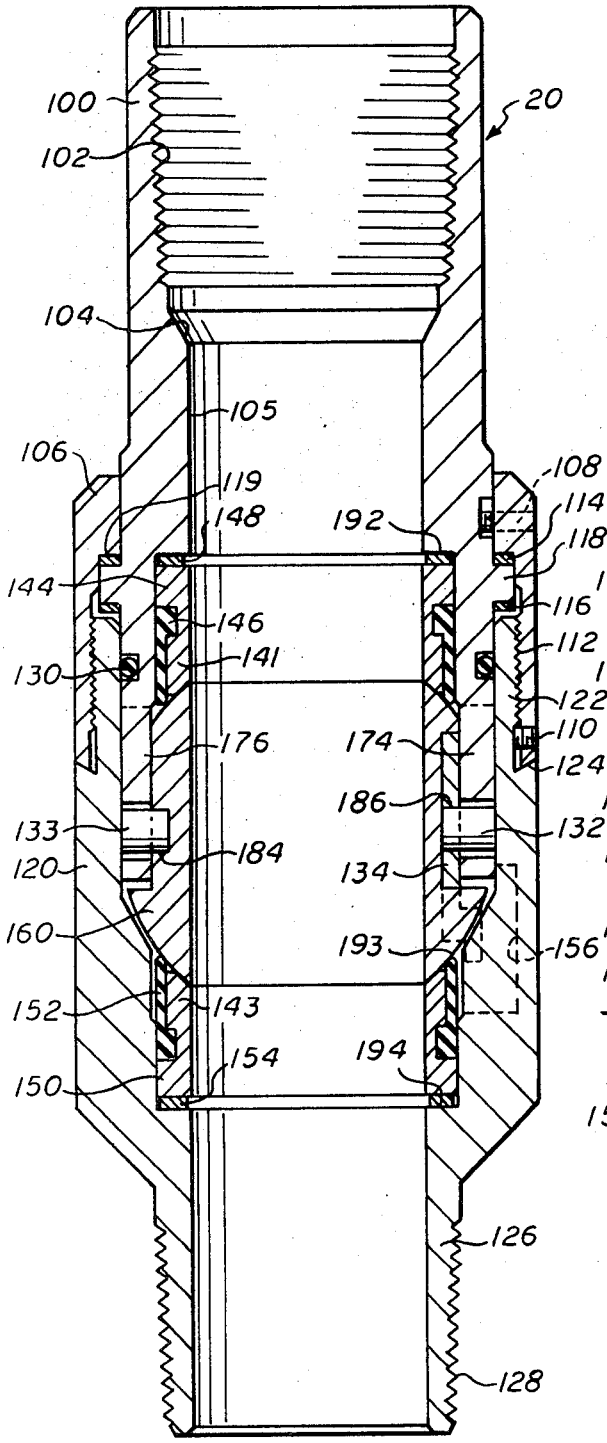
FIG. 3 is a sectional view of the valve apparatus in the open position.
Figure 4:
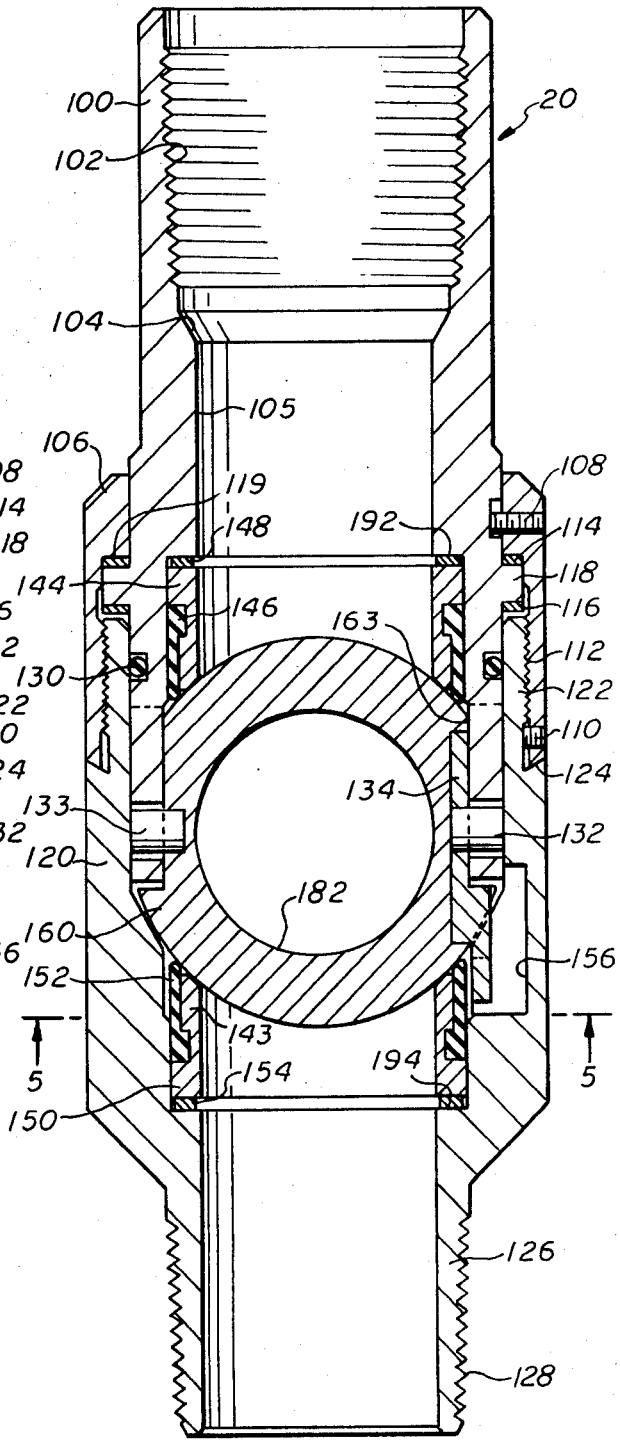
FIG. 4 is a sectional view of the valve apparatus in the closed position.

FIGS. 3 and 4 are sectional views depicting the downhole shutoff valve which may be inserted at an appropriate position in a tubing string. Appropriate threaded connections 102 and 128 are provided above and below the operating ball valve head 160. Tubing T would extend both above and below the valve apparatus, as illustrated by the preferred embodiment of this invention. A conventional on/off connector 10 would generally be employed to attach the upper end of this downhole shutoff valve to the upper tubing string. On the upper end of the preferred embodiment of this valve apparatus is a top sub member 100 having internal threads 102 adjacent its upper end. A sloping or beveled shoulder 104 extends inwardly from the lower end of threads 102 to the cylindrical bore surface 105 which defines the inner diameter of the conduit through the valve apparatus. Top sub member 100 extends downwardly and terminates on opposite sides of the ball valve head apparatus 160. On the lower end of top sub member 100 are two opposite support brackets 174 and 176 upon which ball valve head 160 is mounted.

The lower section of this valve apparatus is defined by a housing member 120 extending below top sub member 102 and encircling brackets 174 and 176. Top sub member 100 and housing member 120 are longitudinally held in position by a cap member 106. Cap member 106 engages housing 120 by means of a threaded connection 112 located along the upper extremities of housing member 120. A shear screw 108 positions cap member 106 with respect to top sub member 100. A set screw 110 located at the bottom of cap member 106 prevents disengagement of the threaded connection 112 between cap member 106 and housing 120. Although top sub member 100 and housing 120 are longitudinally connected, only shear screw 108 prevents rotation of housing 120 with respect to top sub 100 about the axis of the fluid transmission conduit of the tubing and the valve apparatus. An outwardly extending bearing element 118 encircles top sub member 100 and engages a mating recess 119 in cap member 106. Bearing surfaces 114 and 116 between element 118 and a recess 119 carry any axial load during rotation of cap member 100 with respect to housing 120. An O-ring seal 130 encircles top sub member 100 between the mating faces of top sub member 100 and housing member 120 to prevent fluid communication or pressure leakage along these mating surfaces.

Figure 11:
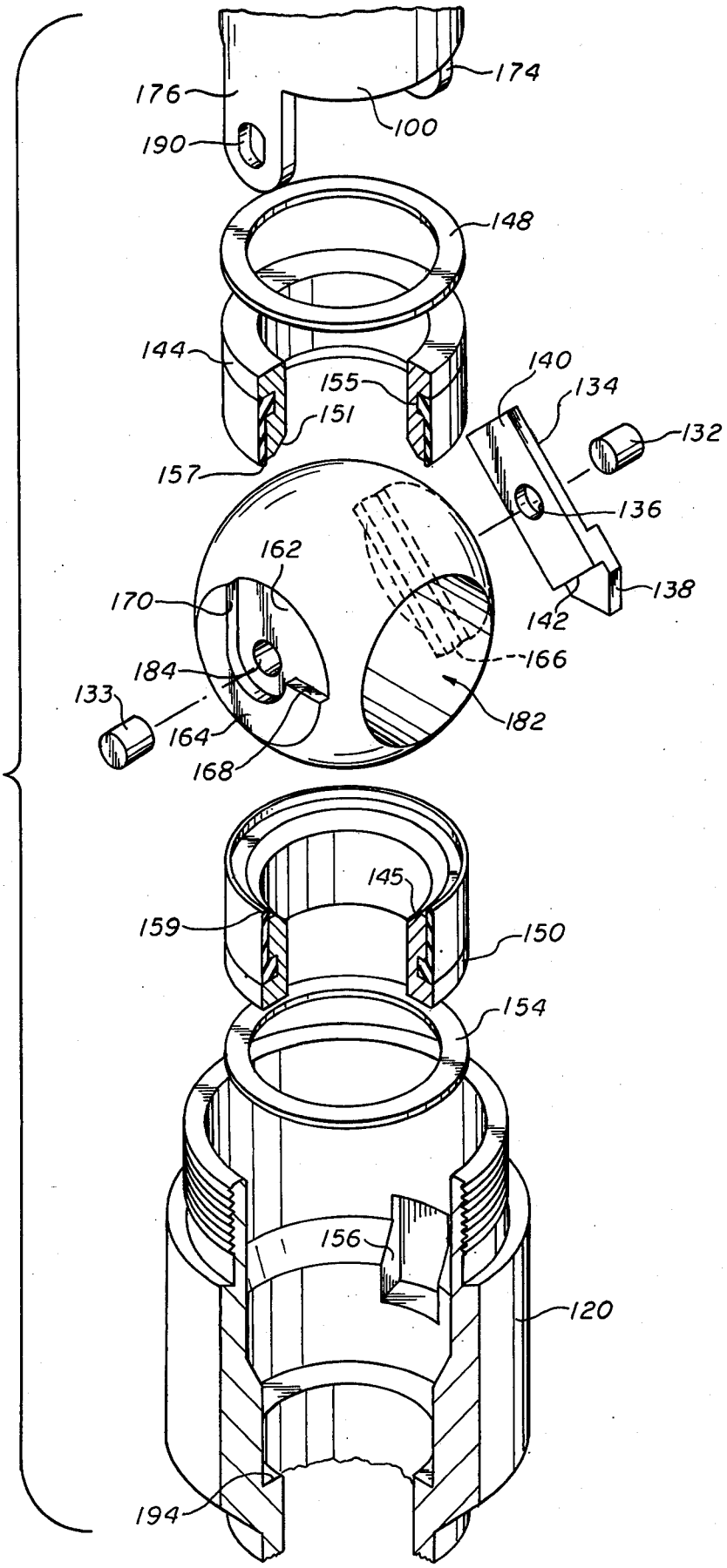
FIG. 11 is an exploded perspective showing the principal component parts of the valve apparatus.

Ball valve head 160, perhaps best shown in FIG. 11, generally comprises a spherical element having a central cylindrical flow passage 182 extending therethrough. Ball valve 160 has generally circular recesses 184 and 186 diametrically opposed and each capable of receiving a cylindrical pin 132 or 133. Pivot recesses 184 and 186 are positioned along an axis generally extending perependicular or transversely to the axis of rotation of cylindrical flow passage 182. The spherical portion of ball valve head 160 terminates along mating face 164 as best shown in FIG. 11. Planar face 164 terminates along transversely inwardly extending shoulders 168 and 170 which, in turn, terminate in a planar surface 162 generally parallel to the plane of face 164. Planar surface 162 intersects the spherical ball valve head 160 along a plane closer to the center of the spherical element than surface 164. A planar surface 163 similar to surface 162 is located on the opposite side of ball valve 160 in the vicinity of the diametrically opposed pivot retaining recess 186. The opposite surface does differ in one respect from the surfaces shown most clearly to FIG. 11. A generally rectilinear cavity 166 intersecting the apex of stop shoulders generally equivalent to 168 and 170 is located along this oppositely facing surface. This cavity 166 is shown by the dotted lines in FIG. 11.

Figure 6:
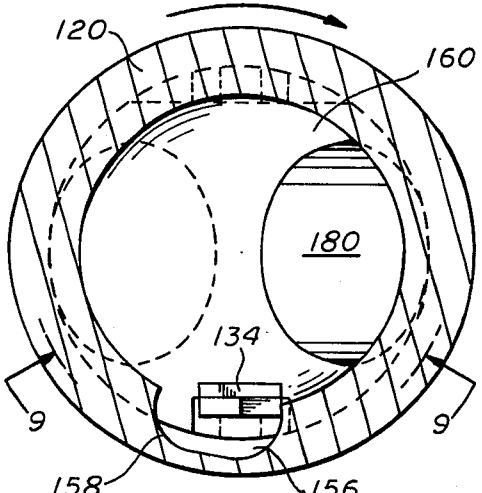
FIG. 6 is a cross-sectional view similar to that of FIG. 5 showing the valve at an intermediate position.

Ball valve 160 is mounted in the valve apparatus on two pivot pins 132 and 133. These pivot pins extend through hole 188 and 190 in ball support brackets 174 and 176 located on the top sub 100. A lever arm or moment arm 134 is located adjacent to one of the two mating faces of ball valve 160. Lever arm 134 is mounted on pivot pin 132 generally between ball valve 160 and portions of the bracket members of the top sub 100 and upper portions of housing 120. Lever arm 134 has a generally rectilinear base member 140 which is received by a rectilinear valve arm groove 166. Lever arm 134 has an integral inclined mating end 138 which, in the preferred embodiment, has inclined surfaces which met to form an arrow configuration. Mating end 138 is offset from the lever arm base 140 forming offset shoulder 142, as illustrated in FIG. 11. Pivot pin 132 extends through a somehwat elongated hole 136 in lever arm base 140 and thence into an appropriate hole along one mating face or ball valve 160. The inclined surface 139 of lever arm mating end 138 are preferably somewhat convex, as best illustrated in FIG. 6.

Figure 7:
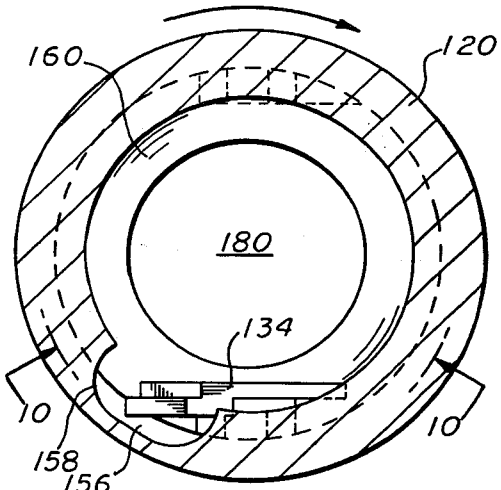
FIG. 7 is a cross-sectional view similar to that of FIG. 5 and for showing the valve in the closed position.
Figure 5:
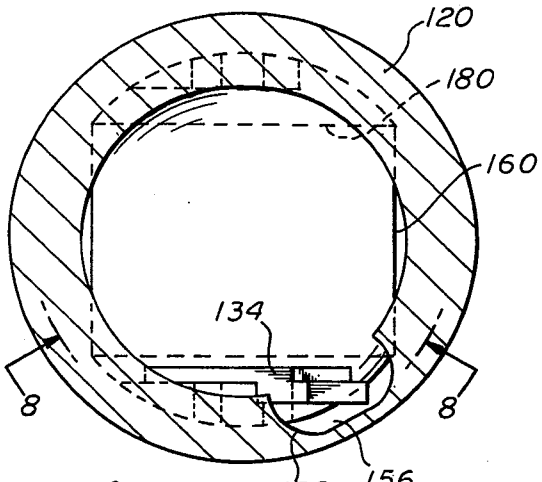
FIG. 5 is a cross-sectional view taken along lines 5—5 of FIG. 4 showing the valve in the closed position.

When viewed in FIGS. 3 and 4, it is apparent that housing 120 has a concave surface 193 along its inner surface to enable partial receipt of ball valve 160. Along one portion of the inner surface of housing 120, in the immediate vicinity of concave surface 193, an oppositely facing concave cavity 156 is formed in housing 120. This concave cavity is formed about an axis parallel to the axis of the bore of the valve apparatus, as can best be seen in FIGS. 5, 6, 7. When ball valve 160 is mounted on support brackets 174 and 176 the offset mating end 138 of lever arm 134 is received in concave cavity 156. In this position, both cavity 156 and the mating surfaces or mating portion of lever arm 134 are spaced from the axis of rotation formed by pivot pins 132 and 133. The convex surface 139 of lever arm mating end 138 abuts a concave portion of housing cavity 156, as can best be seen in FIG. 6. These mating concave and convex surfaces provide a greater area of contact than would otherwise be available if surface 139 were planar.

The central portion of the housing bore of this valve apparatus in the vicinity of ball valve 160 is enlarged and is formed by offset shoulder 192 and 194, as illustrated in FIGS. 3 and 11. Offset shoulder 192 is located on top sub member 100 and offset shoulder 194 is located on housing 120, but the shoulders are otherwise indentical and establish a generally smooth right circular cylindrical bore for receiving ball valve 160, its actuating mechanisms, and seals for use with ball valve 160. As can be seen in FIG. 3, spring members 154 can be located in abutting relation with both shoulders 192 and 194. In the preferred embodiment of this invention. Belleville washers 148 and 154 are located, respectively, on shoulders 192 and 194. Belleville washers 148 and 154 will then exert forces inwardly directed toward each other against any assembly mounted between shoulders 192 and 194. Seal assemblies 141 and 143 are shown in position against Belleville washers 148 and 154 and ball valve head in FIG. 3. Belleville washers 148 and 154 can then exert an inwardly directed force against seal assemblies 141 and 143. Each seal assembly shown in the preferred embodiment of this invention comprises two separate sealing elements. Both upper and lower metal sealing elements 144 and 150 are of similar construction. Concentrating for the moment on upper metal seal element 144, it is apparent that each metallic seal is generally formed as a ring member having a flat base and an inclined mating or seating face 151. Intermediate the upper and lower ends of upper seal element 144, a groove 155 completely encircles the metallic seal element on its outer surface. Elastomeric seal members 146 and 152 can be mounted on the exterior of metallic sealing or seating elements 144 and 150. These elastomeric sealing members can be formed of any number of elastomeric materials which can be used to form a seal in a subterranean conduit. Each elastomeric seal element has an inner mating edge 157 and 159 along the edge immediately adjacent sealing or seating faces 151 and 145. As can be seen in FIG. 3 and 4, the elastomeric sealing element and the metallic sealing or seating members both engage the exterior of spherical valve head means 160. It should be noted that the diameters of the metallic sealing or seating members 144 and 150 and the elastomeric sealing elements 146 and 152 are each greater than the inner diameter of the cylindrical flow passage 172 in ball valve 160. This construction enables the seating or sealing faces of the metallic seals and the sealing edge of the elastomeric seals to be in continuous contact with the exterior of the ball valve.

Now, referring to FIGS. 1, 2, 12 and 13, the tubing connector 10 is affixed by means of threads 11 to the lower end of the fluid transmission conduit T. The tubing connector 10 is generally comprised of two component parts: the outer housing 12 comprised of the top sub 13 and a longitudinally extending wash-over shoe 14: an inner mandrel 15 housed interiorly of the wash-over shoe 14.

The top sub 13 is affixed to the wash-over shoe 14 by means of threads 16, a set screw 17 being secured through the wash-over shoe 14 and into the top sub 13 to provide additional securement. An elastomeric ring 18 is circumferentially defined within a companion groove 19 on the top sub 13 to prevent fluid communication between the top sub 13 and the wash-over shoe 14. Upper and lower seal elements define a seal assembly 50 which is housed in an annular area between the uppermost end of the inner mandrel 15 and the wash-over shoe 14, a beveled shoulder 52 defined interiorly around the wash-over shoe 14 encapsulating seal assembly 50 and preventing its lower movement, while the lowermost end of the top sub 13 encircles the uppermost end of the seal assembly 50 to prevent upward travel of the seal assembly 50. The seal assembly 50 prevents fluid communication between the inner mandrel 15 and the wash-over shoe 14.

Now referring to FIG. 13, a slot assembly 60 is defined around the interior of the wash-over shoe for receipt of a slot pin 62 defined on the inner mandrel 15. The apparatus is run in the hole and set in a mannner known to the art. Then, the conduit T is picked up such that the pin 62 travels from the upper slot 64 through the main carriage 66 to a position in the lower slot 68. Now the slip assembly 34 is engaged along the inner wall of the casing C and the seal assembly 32 is sealingly engaged on the casing C.

The inner mandrel 15 which carries the outwardly protruding slot pin 62 terminates at its lower end by means of thread 70 which serves to affix the inner mandrel 15 to a tubular extension, or alternatively, to the top sub 100 of the valve apparatus 20.

OPERATION

Figure 2:
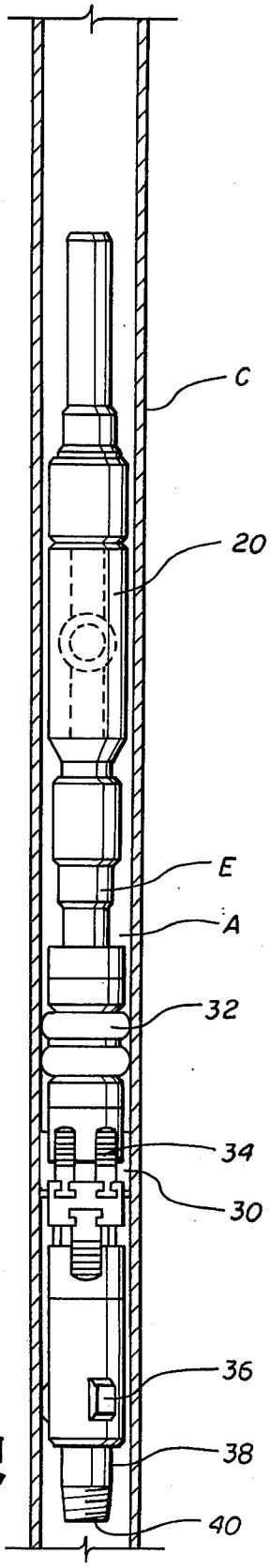
FIG. 2 is a schematic illustration similar to that shown in FIG. 1, the view illustrating the component parts of the apparatus in position in the well after retrieval of the fluid transmission conduit from the connector assembly of the apparatus.

Referring now to FIGS. 1 and 2, the apparatus of the present invention is made up at the bottom of the fluid transmission conduit T with the tubing connector 10 affixed to the lowermost end of the conduit T. The valve apparatus 20 being affixed for communication to the lower end of the tubing connector 10, an extension E being affixed to the lower end of the valve apparatus 20 and insertable through or fixed to the upper end of a pakcer assembly 30. The apparatus is run into the wall within the casing C to the desired depth. When it is desired to set the packer assembly 30 for isolation of the annulus A above the packer assembly 30 with the injection zone therebelow, the conduit T may be rotated or manipulated in some manner to set the packer, as is well known in the art. Subsequently, the conduit T is picked up such that the pin 62 travels along the main carriage 66 until it is received within the lower slot 68. At this time, the slip assembly 34 has expanded into anchored relationship with the casing C and the seal assembly 32 has become sealingly engaged with the I.D. of the casing C. Thereafter, injected fluid may be transmitted through the conduit T, the tubing connector 10, the valve apparatus 20, the extension E, and the packer apparatus 30 into a production zone therebelow. The position of the apparatus now is as illustrated in FIG. 2. When the entire assembly is in the position illustrated in FIG. 2, the conduit may be opened and closed by actuation of the downhole shutoff valve.

Figure 10:
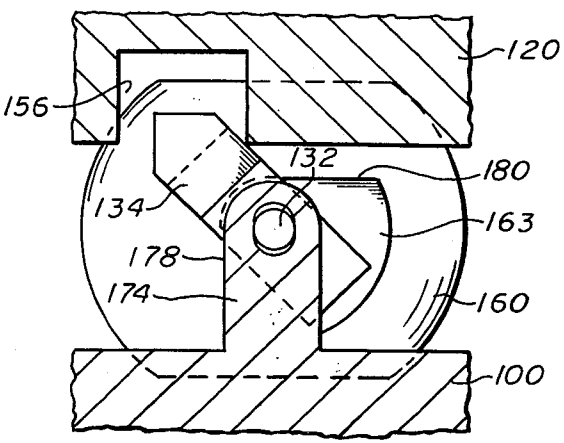
FIG. 10 is a sectional view taken along lines 10—10 showing the completion of the relative movement between the housing recess and the lever arm as the valve is in the closed position.
Figure 9:
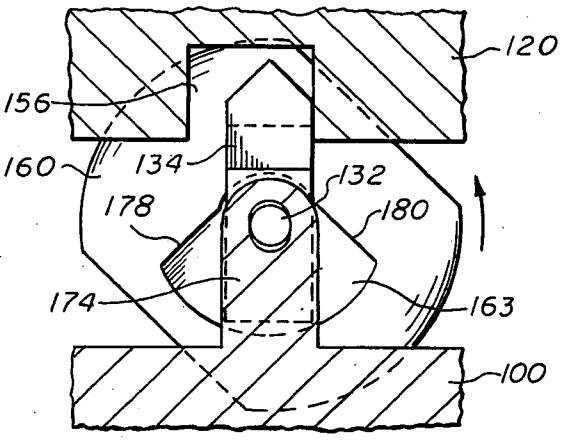
FIG. 9 is a sectional view taken along lines 9—9 and similar to that of FIG. 8 showing the lever arm when the valve is in the intermediate position.
Figure 8:
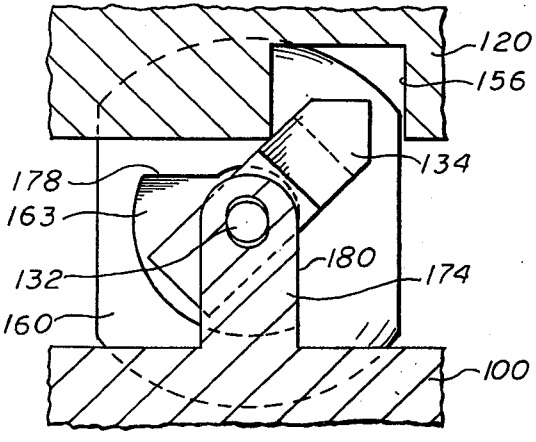
FIG. 8 is a sectional view taken along lines 8—8 in FIG. 5 showing the position of the lever arm when the valve is in the closed position.

The downhole shutoff valve depicted in the preferred embodiment of this invention could typically be operated in conjunction with additional tubing string elements, such as a packer, and it would also be generally operated with an on/off connector 10 mounted on the top of the downhole valve. Tubing T would then normally extend from the upward on/off connector 10 to the surface. After the packer 30, of conventional construction, has been set to anchor the tubing string to the casing of a subterranean well, the ball valve apparatus depicted in this invention could then be operated by simple rotational manipulation of the tubing string. The ball valve downhole shutoff valve apparatus shown in this invention would typically be fixed in a partially open configuration during running in of the tubing into the well. This partially open configuration of 45° configuration is shown in FIG. 6. By positioning the valve in this manner, the tubing string could be lowered into the well and the pressures existing below or above the valve can be equalized during insertion. During the initial run in of the tubing, ball valve head 160 is held in the partially open or 45° position by means of set screw 108 which prevents top sub 100 and the ball valve from rotating with respect to the tubing. When the tubing is in the desired position and has been anchored to the casing by means of a conventional packer, the valve apparatus can be freed for normal operation by rotating the tubing string extending above the ball valve. If lower housing 120 is affixed to a section of tubing T which is not free to rotate, right hand rotation of the upper tubing string T will cause ball valve 160 to move from the partially open configuration of FIG. 6 to the fully open configuration of FIG. 7. In order to allow such rotary activation of top sub 100 and rotation of ball valve 160, top sub 100 must be freed by the application of sufficient torque to shear set screw 108. The upper tubing and top sub 100 are now free to rotate with respect to the lower housing 120 through an angle of 90° in the preferred embodiment. Assuming ball valve 160 is in the position shown by FIG. 5 right hand rotation of the upper tubing will cause the ball valve 160 to move through immediate positions illustrated by the 45° configuration of FIG. 6 to the fully open configuration of FIG. 7. In FIG. 8 it is apparent that bracket members 174 and 176 abut shoulder 180 on the ball valve when the valve is in the completely closed position. As the tubing string moves through an angle of 90°, the ball will also rotate about a separate transverse or perpendicular axis through an angle of 90° until the opposite offset shoulder 178 (FIG. 10) abuts the opposite surface of one of the bracket members 174 and 176. Rotation of ball valve 160 about an axis perpendicular to the tubing string is imparted by means of a moment induced about the pivoting axis of the ball through lever arm 134. As top sub 100 moves rotationally with respect to stationary lower housing 120, the lever actuating cavity 156 transmits a force to the mating end of lever 134. This force is transferred about a fulcrum defined by pivot pins 132 and 133 and thence to the spherical ball valve 120. The surface defining cavity 156 is adjacent to cylindrical seal assembly 143 and its relative moment is along a circular path with a diameter greater than the outer diameter of the cylindrical seal assembly. Note that the opposite end of lever arm 134 is retained in cavity 166 and the lever arm is not free to rotate with respect to the ball. A sufficient moment is therefore transferred to the ball to enable relatively easy activation of the ball even in the presence of relatively high differential pressures. The convex surface 139 formed on lever arm mating end 138 does enable the transmission of greater force to the ball valve than could be obtained if a planar surface were utilized. If a planar surface is utilized, a smaller area will contact the inner concave surfaces or recess or cavity 158 generating higher pressures and effectively decreasing the force which could be imparted to the lever arm. This invention permits the activation of a downhole shutoff valve with the application of less force than might otherwise be required.

After the conduit above the valve apparatus 20 has been rotated sufficiently at the surface of the well to cause a 90° turn of the ball valve 160, the tubing T extending above the valve apparatus 20 may be tested for pressure integrity by utilizing surface valves. If the ball valve is in the closed position, as illustrated by FIG. 4, the tubing string above the valve should hold pressure if the tubing string is in satisfactory condition. Otherwise, pressure exerted from the surface will either bleed-off if the ball valve 160 is in the open position of FIG. 3 or will be lost where the tubing does not have sufficient integrity. With ball valve 160 in the closed position, the upper portion of tubing T may be safely disengaged from the tubing connector 10. Additional torque applied to conduit T in combination wiht a slight pick up of the tubing will cause the pin 62 to travel from within the upper slot 64 along the wall 69, thence out of the lower end of the slot 60. When this is accomplished, the outer housing 12 of on/off connector 20 is completely free of the inner mandrel 15 and may be retrieved along with the upper portion of conduit T. The inner mandrel 15 will remain in the well bore affixed to the remaining component parts of the appartus.

The tubing may be later engaged onto the top of the tubing connector 20 and the valve apparatus 20 may be manipulated from the closed to the open position by reversing the steps set forth above.

Although the invention has been described in terms of the specified embodiment which is set forth in detail, it should be understood that this is by illustration only and that the invention is not necessarily limited thereto, since alternative embodiments and operating techniques will become apparent to those skilled in the art in view of the disclsoure. Accordingly, modifications are contemplated which can be made without departing from the spirit of the described invention.

What is claimed and desired to be secured by Letters Patent is:

1. Apparatus for the selective disengagement of a fluid transmission conduit insertable through a second conduit for communication to a zone within a wall bore, and for control of fluid transmission from said zone upon disengagements of said fluid transmission conduit, comprising: packing means having a flow path communicating with the interior of said fluid transmission conduit and for isolating an annular area between said fluid transmission conduit and said second conduit and above said zone; valve means having a flow passageway selectively communicable with said fluid transmission conduit and with the flow path of said packing means, said valve means further comprising ball valve head means responsive to rotary manipulation of the fluid transmission conduit above said valve means to selectively open and close said fluid transmission conduit, said valve means further comprising sealing means engaging said ball valve head means above and below said ball valve head means to provide sealing integrity both above and below said valve means; and conduit disengagement means on said fluid transmission conduit above said valve means and having a flow path communicating with and carriable by said fluid transmission conduit, said conduit disengaging means being responsive to rotation of said fluid transmission conduit after manipulation of said valve means to a closed position to disengage said fluid transmission conduit.

2. Apparatus for the selective disengagement of a fluid transmission conduit insertable through a second conduit for communication to a zone within a well bore, and for control of fluid transmission from said zone upon disengagement of said fluid transmission conduit, comprising: anchoring means for restraining a portion of said fluid transmission conduit against rotation in a first direction about the axis of said fluid transmission conduit; ball valve means having a flow passageway selectively communicable with said fluid transmission conduit, said ball valve means being responsive to rotary manipulation of said fluid transmission conduit above said ball valve means in a direction opposite from said first direction to selectively close said fluid transmission conduit; sealing means engaging said ball valve means above and below said ball valve means providing sealing integrity both above or below said ball valve means when said ball valve means closes said fluid transmission conduit; and conduit disengaging means above said valve means and having a flow passageway communicating with and carriable by said fluid transmission conduit, said conduit disengaging means being responsive to rotation of said fluid transmission conduit after manipulation of said valve means to a closed position to disengage said fluid transmission conduit.

3. Apparatus for opening and closing a fluid transmission conduit insertable through a second conduit for communication to a zone within a well bore, said apparatus comprising: anchoring means for securing a portion of said fluid transmission conduit to said second conduit; conduit disengaging means; and valve means responsive to rotary manipulation of said fluid transmission conduit to selectively close said fluid transmission conduit, said valve means further comprising housing means having a cylindrical bore extending therethrough; ball valve means located between opposite ends of said cylindrical bore; pivot means upon which said ball valve means is mounted, said ball valve means being rotatable on said pivot means about an axis transverse to said cylindrical bore; lever means mounted on said pivot means for imparting rotation to said ball valve means upon rotary manipulation of said fluid transmission conduit; and plural sealing means located on opposite sides of said ball valve means between said ball valve means and said housing means.

4. Apparatus adapted to open and close a fluid transmission conduit insertable through a second conduit insertable through a second conduit for communication to a zone within a well bore, said apparatus comprising: anchoring means for restraining a portion of said fluid transmission conduit against rotation in a first direction about the axis of said fluid transmission conduit; conduit disengaging means having a flow passageway communicating with said transmission conduit to permit flow therethrough and carriable on said fluid transmission conduit; said conduit disengaging means being responsive to rotation of said transmission conduit in said first direction to disengage the portion of tubing string extending thereabove from the portion of tubing string extending therebelow; valve means positioned between said conduit disengaging means and said anchoring means, said valve means comprising ball valve means having a fluid passageway therethrough selectively communicable with said fluid transmission conduit as said ball valve means rotates about a pivot axis transverse to said fluid transmission conduit; said valve means further comprising upper and lower mutually rotatable annular housing members having mutually aligned bores; means securing said upper housing member for co-rotation with said tubular conduit; said lower housing member being fixed with respect to said anchoring means; said ball valve means being pivotally mounted on said upper housing member; lever means having first and second spaced apart ends and acting about a fulcrum coincident with the pviot axis of said ball valve means, one end of said lever means engaging said ball valve means and the other end of said lever having abutting engagement with said lower housing member at a point below and spaced from the transverse axis of rotation of said lever means and said ball valve means, whereby rotation of said upper housing member in said one direction by said fluid conduit produces a rotation of said ball valve means to a closed position.

5. Apparatus as set forth in claim 4 wherein said lever means abuts said lower housing member within an internal cavity extending tranversely of said bore in said lower housing member.

6. Apparatus as set forth in claim 4 or 18 wherein rotation of said fluid conduit through an angle of 90% at said valve apparatus induces a rotation of said ball valve head means through an angle of 90° about said axis transverse to said fluid transmission conduit.

* * * * *